US005183353A

United States Patent [19]

Buckelew

[11] Patent Number: 5,183,353

[45] Date of Patent: Feb. 2, 1993

[54] PAVEMENT HOLE SEAL COVERED REPAIR FILL

[76] Inventor: Jack E. Buckelew, P.O. Box 64840, Dallas, Tex. 75206

[21] Appl. No.: 780,070

[22] Filed: Oct. 21, 1991

[51] Int. Cl.[5] ..... E01C 11/02

[52] U.S. Cl. ..... 404/69; 404/75

[58] Field of Search ..... 404/75, 72, 17, 32, 404/33, 67, 69

[56] References Cited

U.S. PATENT DOCUMENTS

| | | | |
|---|---|---|---|
| 3,625,119 | 12/1971 | Gagile et al. | 404/72 |
| 3,900,687 | 8/1975 | Meader et al. | 404/32 |
| 3,915,582 | 10/1975 | Clarke | 404/75 |
| 3,930,100 | 12/1975 | McDonald | 404/32 |
| 4,113,401 | 9/1978 | McDonald | 404/75 |
| 4,334,798 | 6/1982 | Milne | 404/75 |
| 4,556,338 | 12/1985 | Fahey | 404/28 |
| 4,684,288 | 8/1987 | Chapa | 404/35 |

FOREIGN PATENT DOCUMENTS

| | | | |
|---|---|---|---|
| 2207940 | 2/1989 | United Kingdom | 404/75 |

*Primary Examiner*—Ramon S. Britts
*Assistant Examiner*—Roger J. Schoeppel
*Attorney, Agent, or Firm*—Warren H. Kintzinger

[57] ABSTRACT

A seal-cover is provided for paving material filled pavement openings such as pot holes. A hot mix (used in good weather) or a cold mix (used in bad weather) of asphalt paving repair material is used to fill a hole in the existing pavement. A coating or layer of tar is put down covering the asphalt fill in a pavement hole and extending outward beyond the hole periphery to the extent of being approximately eight inches larger than the hole patch. A roofing material such as roofing tar paper, an asphalt or tar and fiberglass coating material or even a vinyl flooring material slightly less area than the layer of tar is then laid down over the layer of tar previously laid down. This water tight construction over asphalt fill repaired pot holes, keeping water out of patch areas, greatly aids in new repair standing up to heavy traffic and thereby greatly extends patch life running to many years.

12 Claims, 1 Drawing Sheet

PAVEMENT HOLE SEAL COVERED REPAIR FILL

Figure 1:
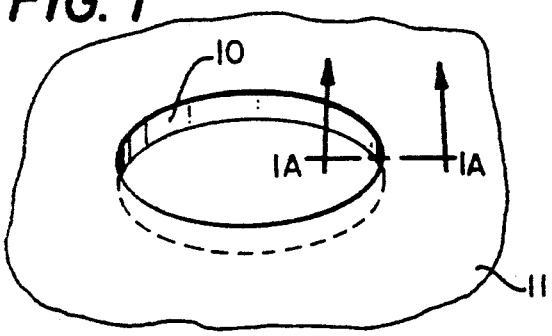

This invention relates in general to pavement pot hole repair and, in particular, to water tight seal over covering of paving material filled pavement openings such as pot holes.

Pot holes in roads, streets, highways, driveways and parking lots develop from vehicle travel over the pavement laid down coupled with the effects of weather changes particularly temperature and the amount of water in the hole subject to repeated cycles of freezing and thawing. Whenever pavement holes are repaired it is extremely important that water be removed from a hole being repaired and that after a pavement hole is filled with repair paving material that the top be so sealed as to prevent reentry of water to the hole and the repair paving material used to fill the hole. This sealing of the paving material hole whether a hot mix is used in good weather or a cold mix is used in bad weather from water entry from the top is very important in extending pavement patch life running to many years.

It is, therefore, a principal object of this invention to greatly extend the service life of pavement hole pavement material patches.

Another object is to save expense through the extended service life of pavement hole repairs.

Still another object is to make road, street and highway travel safer with the vehicle driver encountering fewer pot holes in pavement than heretofore.

A further object is to conserve repair pavement material and require fewer road repair service personnel for proper road repair.

Features of the invention useful in accomplishing the above objects include, in pavement material fill repair of pavement holes with water tight sealing at the top of each pavement hole pavement material repair fill, with a seal over cover provided for paving material filled pavement openings such as pot holes. A hot mix (used in good weather) or a cold mix (used in bad weather) of asphalt paving repair material is used to fill a hole in the existing pavement. A coating or layer of tar is put down overlay covering the asphalt fill in a pavement hole and extending outward beyond the hole periphery to the extent of being approximately eight inches larger than the hole patch. A roofing material such as roofing tar paper, an asphalt or tar or fiberglass coating material or even a vinyl floor material of slightly less area than the layer of tar is then laid down over the layer of tar previously laid down. This water tight construction over asphalt fill repaired pot holes, in keeping water out of patch areas, greatly aids in new repair standing up to heavy traffic and thereby greatly extends patch life running to many years.

A specific embodiment representing what is presently regarded as the best mode of carrying out the invention is illustrated in the accompanying drawing.

Figure 1A:
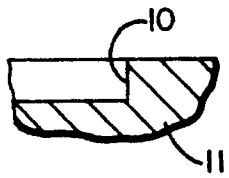

In the drawing:

FIG. 1 represents a perspective view of a hole in pavement that needs patching repair;

FIG 1A, a partially cut away and sectioned view taken along line 1A—1A of FIG. 1, showing paving hole detail.

Figure 2:
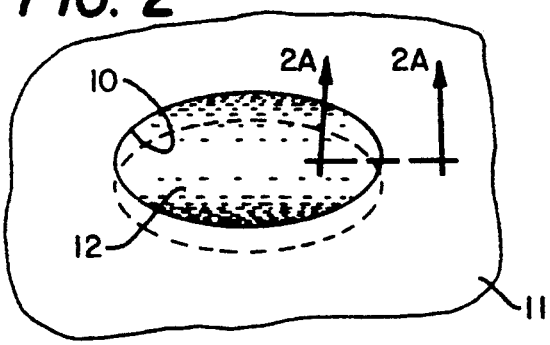
Figure 2A:
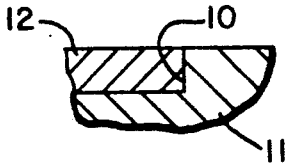
Figure 3:
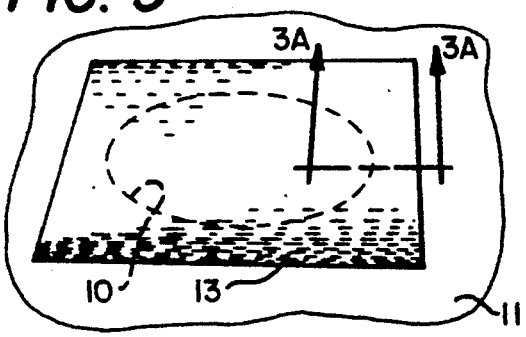
Figure 3A:
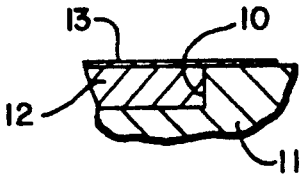
Figure 4:
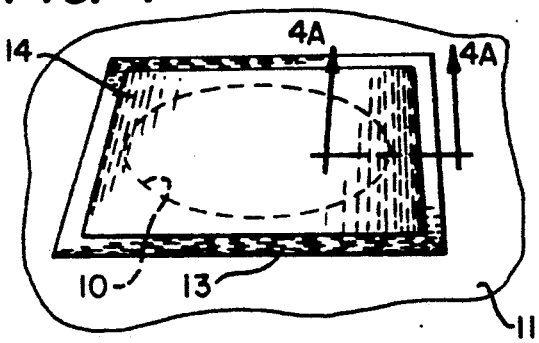
Figure 4A:
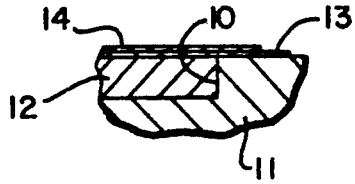

FIG. 2, a perspective view like FIG. 1 with the pavement hole filled with pavement repair material;

FIG. 2A, a partially cut away and sectioned view taken along line 2A—2A of FIG. 2 showing detail of the hole filled with pavement repair material;

FIG. 3, a perspective view like FIGS. 1 and 2 with a layer of tar put down overlay covering the pavement material fill in the pavement hole and extended outward beyond the hole's peripheral edge;

FIG. 3A, a partially cut away and sectioned view taken along line 3A—3A of FIG. 3 showing additional tar layer overlay extended beyond the hole edge;

FIG. 4, a perspective view like FIGS. 1, 2 and 3 with a water tight material such as tar paper, an asphalt or tar coated fiberglass sheet material, or even vinyl flooring material cut to a cross sectional area slightly less than the area of the layer of tar previously laid down; and, FIG. 4A, a partially cut away and sectioned view taken along line 4A—4A of FIG. 4 showing additional hole repair detail with water tight sealing sheet positioned in place of the layer of tar previously laid down.

Referring to the drawings:

The hole 10 in pavement 11 (a concrete or asphalt pavement) as shown in FIGS. 1 and 1A has been cleaned of loose material from the hole (or pot hole) now conditioned to receive pavement repair material fill 12 as shown in FIGS. 2 and 2A. After compaction of the pavement repair material fill 12, a hot mix (used in good weather) or a cold mix (used in bad weather) of asphalt paving repair material used to fill a hole in existing pavement 11, a coating or layer of tar 13 is put down overlay covering the asphalt fill 12 in the pavement hole 10 as shown in FIGS. 3 and 3A. Please note that pavement holes (pot holes) are not necessarily straight vertical sided holes such as with hole 10, that has been cleaned and shaped to that state for repair, but may also be slope edged as long as they have been cleaned of loose deteriorated paving material. The coating or layer of tar 13 is applied over the entire top of pavement repair material fill 12 and edgewise outward beyond the peripheral edge some four inches or more in every direction so that the tar layer is, transversely, approximately eight inches larger than the hole 10 and pavement repair fill 12. A sheet of material 14 from the class of materials including: roofing tar paper, an asphalt or tar impregnated fiberglass coating material, or even a linoleum or vinyl flooring material cut to slightly less area than, and to the same shape of, the tar layer 13 previously laid down (please refer to FIGS. 4 and 4A). This water tight construction over asphalt fill (or other paving material fill) repaired pavement holes (pot holes), in keeping water out of patched repaired areas, greatly aids in new repair standing up to heavy traffic and also thereby greatly extends patch life running to many years.

Please note that the sheet of material 14 would generally be a woven material impregnated with plastic, asphalt or tar for long life structural integrity and waterproof tightness.

Whereas this invention has been described with respect to a single embodiment thereof, it should be realized that various changes may be made without departure from the essential contributions to the art made by the teachings hereof.

I claim:

1. A water tight seal over covered paving repair material filled pavement hole comprising: a cleaned out pavement opening filled with a paving repair material fill tightly compacted therein; a coating layer of tar applied over the top of the paving repair material fill and extended outwardly beyond the peripheral edge of the hole and fill therein in every direction; and a sheet, laid down on said layer of tar, of material from the class of materials including, tar paper, an asphalt impregnated fiberglass coating material, a tar impregnated fiberglass coating material, linoleum and vinyl flooring material cut to slightly less area than and while smaller in area to substantially the same shape of the tar layer previously laid down.

2. The water tight seal over covered paving repair material filled pavement hole of claim 1, wherein said paving repair material fill is asphalt.

3. The water tight seal over covered paving repair material filled pavement hole of claim 2, wherein said hole is filled with a hot mix of asphalt.

4. The water tight seal over covered paving repair material filled pavement hole of claim 2, wherein said hole is filled with a cold mix of asphalt.

5. The water tight seal over covered paving repair material filled pavement hole of claim 2, wherein said sheet includes woven matting impregnated with a water tight sealant material.

6. The water tight seal over covered paving repair material filled pavement hole of claim 5, wherein said layer of tar is spread to extend outwardly beyond the peripheral edge of the hole and fill therein in the range of approximately three to eight inches in every direction.

7. The water tight seal over covered paving repair material filled pavement hole of claim 6, wherein said sheet of water tight material extends to a lesser extent than said layer of tar and while smaller in area it is cut to substantially the same shape as the layer of tar previously laid down whereby the layer of tar completely underlies said sheet of water tight material.

8. A method of repairing holes in pavement such as pot holes in streets and roads with steps comprising: cleaning out loose and defective pavement and matter from the hole; inserting paving repair material fill in the hole and tightly compacting the fill in the hole to a level top surface generally coplanar with the top surface of hole surrounding pavement; applying a coating layer of tar over the top surface of said fill and over a peripheral fringe area extended outwardly beyond the peripheral edge of the hole and fill therein in every direction; and laying down a sheet on said layer of tar, of material from the class of materials including, tar paper, an asphalt impregnated fiberglass coating material, a tar impregnated fiberglass coating material, linoleum and vinyl flooring material cut to slightly less area than and while smaller in area to substantially the same shape of the tar layer previously laid down.

9. The method of claim 8, wherein said paving material fill is asphalt.

10. The method of claim 8, wherein said sheet includes woven matting impregnated with a water tight sealant material.

11. The method of claim 8, wherein said layer of tar is spread to extend outwardly beyond the peripheral edge of the hole and fill therein in the range of approximately three inches to eight inches in every direction.

12. The method of claim 11, wherein said sheet of water tight material extends to a lesser extent than said layer of tar and while smaller in area it is cut to substantially the same shape as the layer of tar previously laid down whereby the layer of tar completely underlies said sheet of water tight material.

* * * * *